United States Patent [19]

Benno

[11] 4,153,155

[45] May 8, 1979

[54] FLUID COLLECTOR AND MULTIPACKAGE SYSTEM

[75] Inventor: Edward L. Benno, Grayslake, Ill.

[73] Assignee: Illinois Tool Works Inc., Chicago, Ill.

[21] Appl. No.: 855,034

[22] Filed: Nov. 25, 1977

Related U.S. Application Data

[63] Continuation of Ser. No. 779,864, Mar. 21, 1977, abandoned.

[51] Int. Cl.[2] ..... B65D 75/00; B65D 25/14

[52] U.S. Cl. ..... 206/150; 220/85 B; 220/404; 220/470; 220/1 C; 220/1 V

[58] Field of Search ..... 220/1 C, 1 T, 1 V, 23.83, 220/23.86, 63 R, 85 B, 527, 404, 410, 470; 184/106; 141/314; 206/150

[56] References Cited

U.S. PATENT DOCUMENTS

| | | | |
|---|---|---|---|
| 1,935,074 | 11/1973 | Brandon | 220/63 R |
| 3,052,371 | 9/1962 | Bemmelen | 220/63 R |
| 3,173,573 | 3/1965 | Donegan | 220/63 R |
| 3,187,934 | 6/1965 | Huber | 220/63 R |
| 3,227,305 | 1/1966 | Enssle | 220/63 R |
| 3,394,865 | 7/1968 | Leblanc | 229/51 DB |
| 3,711,145 | 1/1973 | Rapata | 206/150 |
| 4,022,257 | 5/1977 | O'Connell | 184/106 |

*Primary Examiner*—William Price

*Assistant Examiner*—Joseph Man-Fu Moy

*Attorney, Agent, or Firm*—Robert W. Beart

[57] ABSTRACT

A fluid collector for collecting fluid from a drain opening such as a motor vehicle crankcase or engine oil pan and a multipackage of the fluid collector and plurality of replacement-fluid containers. The fluid collector in a preferred embodiment comprises a sealed container carrying a folded bag therein. In a certain open condition of the container the bag is capable of receiving a substantial quantity of drain fluid and the container holds the open end of the bag as a funnel for receiving fluid from a drain opening. The container is resealable for transport and disposal of the bag and container with the drained fluid therein.

In a preferred embodiment, the container is of the same size as replacement-fluid containers which are to be used to replace the drained fluid. Thus, for example, that embodiment contemplates standard quart oil cans such as used to place oil in motor vehicle engines. In the multipackage, an odd number of oil cans are multipackaged with the fluid collector in a rectangular array as a unitary assembly. The invention further contemplates that the oil cans and fluid collector be multipackaged by a plastic sheet-formed strip having a plurality of container receiving apertures therein, such as is well-known for packaging beer and soft drinks in six-packs.

7 Claims, 5 Drawing Figures

FLUID COLLECTOR AND MULTIPACKAGE SYSTEM

This is a continuation, of application Ser. No. 779,864, filed Mar. 21, 1977 now abandoned.

BACKGROUND OF THE INVENTION

The invention in a preferred embodiment is intended for use in servicing automobiles and particularly in performing an oil change for an automobile engine. Recently, segments of the oil industry have begun marketing quart oil cans in convenient multipackages for use in performing engine oil changes. In performing an engine oil change, an ever present problem with the average automobile owner is the problem of collecting and disposing of the used oil drained from the engine oil pan or crankcase. Known pans and trays are often used with the attendant problem of then disposing of the used oil in the collecting pan. Secondary containers and other known disposal arrangements are generally messy and inadequate arrangements. The present invention provides an economical and efficient solution to the problem of collecting and disposing of drained automobile engine oil in performing an engine oil change.

SUMMARY OF THE INVENTION

In a preferred embodiment of the invention, unique advantage is taken of the fact that many automobiles require no more than five quarts of oil for an oil change and that most automobiles have engine oil pan drain openings that are very close to the ground. Further as a system for changing automobile engine oil, the invention provides for a multipackaging arrangement wherein the replacement-oil cans and the oil collector may be economically and efficiently assembled as a multipackage and further economically distributed in the marketplace.

In a preferred embodiment, the used-oil collector is made in the same size and shape as a standard quart oil can. In that size and shape the used-oil collector is easily fed into known multipackaging lines to be multipackaged with, for example, five quart oil cans. One such multipackaging machine is shown, for example, in U.S. Pat. No. 3,032,943. The multipackaging machine of that patent uses a strip of plastic material carriers, such as taught in U.S. Pat. No. 2,874,835 to apply the carrier strip automatically to two rows of containers proceeding through the machine. To form six-packs the machine severs the carrier strip after every three pairs of containers. Thus, merely by using such a well-known multipackaging system, a complete and economical package of five quarts of oil and a used-oil collector is provided. That package is thereafter easily handled in normal known distribution systems to the consumer, and is further conveniently handled and used by the consumer in performing an oil change operation on his automobile.

Further in a preferred embodiment, the used-oil collector container is provided with a lid that may be pried from the container to open the upper end of the container and that after use may be reapplied to seal the upper end of the container. A folded bag is disposed within the collector container and the open end of the bag is secured about and within the rim of the collector container. One sidewall of the collector container is provided with a weakened area for manual removal of that portion of the sidewall. After the sidewall of the collector container has been removed, the bag is drawn through the sidewall of the collector container and positioned in an extended arrangement exteriorly of the container. Using the collector container as a self-supporting funnel, the opened collector container is placed beneath the oil pan of an automobile and the oil drain plug is removed. The used oil will flow into the open upper end of the container and the open end of the bag. The oil will thereafter flow out of the container through the sidewall into the extended portions of the bag. Preferably, the bag is of a tubular shape and has a length sufficient to receive the total volume of used oil to be drained from the automobile engine. For most automobiles, the bag should hold five to six quarts of fluid. After draining of the engine is completed, the oil pan drain plug may be replaced, the collector container resealed with its lid, and the collector container and the oil-filled bag may be drawn from beneath the automobile and carried to an appropriate place for disposal. The replacement-oil cans in the multipackage may then be opened and drained into the automobile engine.

The primary object of the present invention is to provide a fluid collector and a multipackaging arrangement including the fluid collector and a replacement fluid supply that is economical and efficient to use in assembling of the fluid collector with replacement fluid containers to provide a stable, compact package for transport and marketing, and in which the fluid collector is easily and efficiently used for the collection and disposal of fluid draining from a relatively inaccessible location such as the oil drain pan of an automobile. Other objects and features of the invention will be apparent upon a perusal of the hereinafter following detailed description read in conjunction with the drawings.

DETAILED DESCRIPTION OF THE PREFERRED EMBODIMENTS

Figure 1:
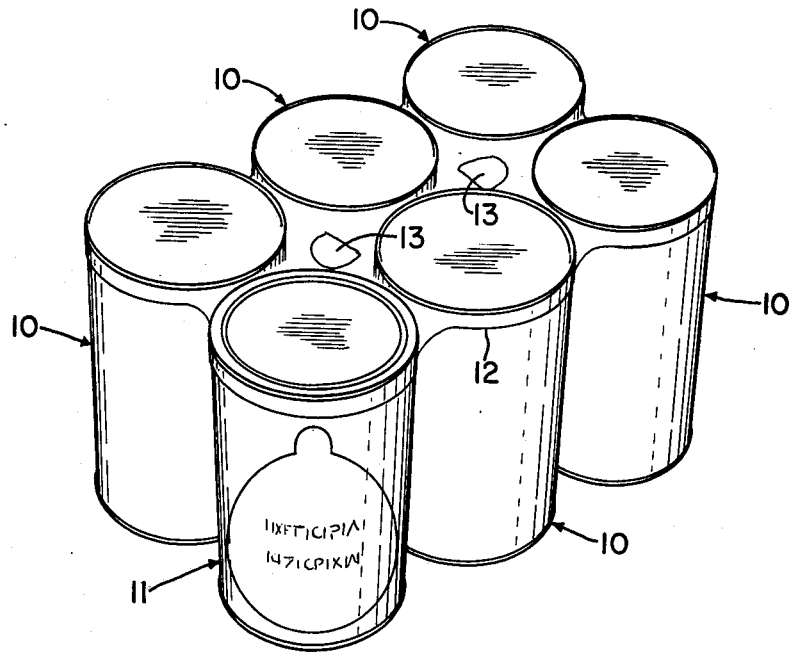
FIG. 1 is an isometric view of one embodiment of a multipackage made according to the system of the invention.

In the embodiment shown in the drawing and in other embodiments hereinafter described, the invention finds particular utility in a system for performing an oil change operation on an automobile engine. Owners of automobiles desiring to drain and replace the engine oil in their automobiles presently find known procedures messy, time consuming and, oftentimes, uneconomical. Further, when one must purchase substantially more oil than is needed for an oil change, one is faced with the additional investment needed and the problem of storing the excess replacement oil until needed. Many people will avoid an engine oil change procedure because of the attendant difficulties in collecting the used oil in some form of container and in later disposing of the used oil. It is believed that the present invention teaches one oil change system having many advantages over known systems used in the art.

FIG. 1 shows a six-pack of five replacement-oil containers 10, a used-oil collector 11 and a multipackaging device 12. The package of FIG. 1 is shown with five cans of oil 10 because it is believed that quantity of oil is sufficient for changing the engine oil in the average automobile. In the present embodiment, it is contemplated that the replacement-oil containers or cans 10 be of the well-known one-quart size. That size in a multipackage of five quarts is relatively easily carried by a person. Obviously, in the use of replacement-oil containers in metric sizes, a comparable sized container may be used. Further, the number of oil containers 10 may be varied for use with automobiles substantially smaller or larger than the average. Thus, three or seven oil containers 10 may be multipackaged with the oil collector 11 when desired. The rectangular array of an odd number of containers 10, plus the fluid collector 11, is a desirable package configuration for shipping and storage of such packages in large numbers.

Preferably, the fluid collector 11 is of the same size and shape as the oil containers 10 to permit the noted convenient generally rectangular complete package.

Although other forms of multipackaging may be used, one convenient multipackaging system for producing the packages of the invention uses a multipackaging device such as that shown at 12 in FIG. 1. The multipackaging device 12 is formed from a sheet of resilient elastic plastic material in the shape of a plurality of annular bands integrally interconnected in two rows with convenient finger grips 13 formed in the plastic sheet material between the annular bands for convenient gripping and carrying of the package. The annular bands initially have an inner peripheral dimension less than the circumferential dimension of the containers so that the annular bands are stretched and applied over the tops of the containers in circumferential gripping engagement therewith. Such carrier devices 12 are well-known in the multipackaging art and may be seen, for example, in U.S. Pat. No. 2,874,835. Because the fluid collector 11 is the same size and shape as the oil containers 10, a carrier device 12 of uniform shape may be applied to the fluid collector 11 and the oil containers 10.

In applying a carrier device such as carrier device 12 to the fluid collector 11 and the oil containers 10, known multipackaging machines such as the machine shown, for example, in U.S. Pat. No. 3,032,943 may be used to conveniently and rapidly form the package of FIG. 1.

Figure 2:
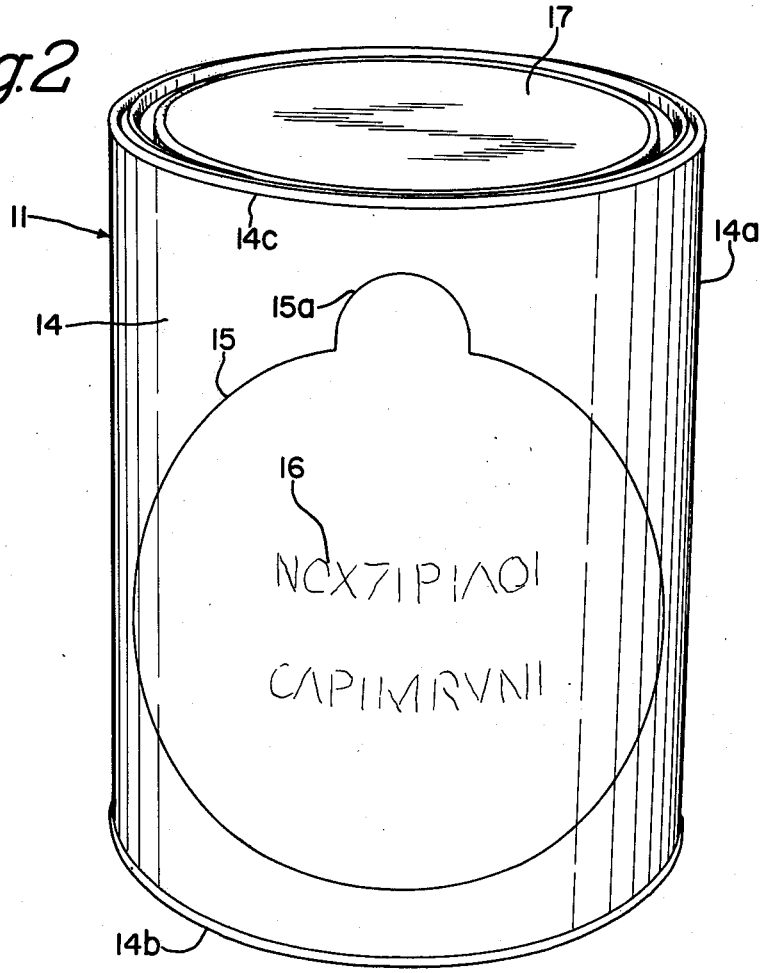
FIG. 2 is an enlarged isometric view of one embodiment of a fluid collector of the invention.
Figure 3:
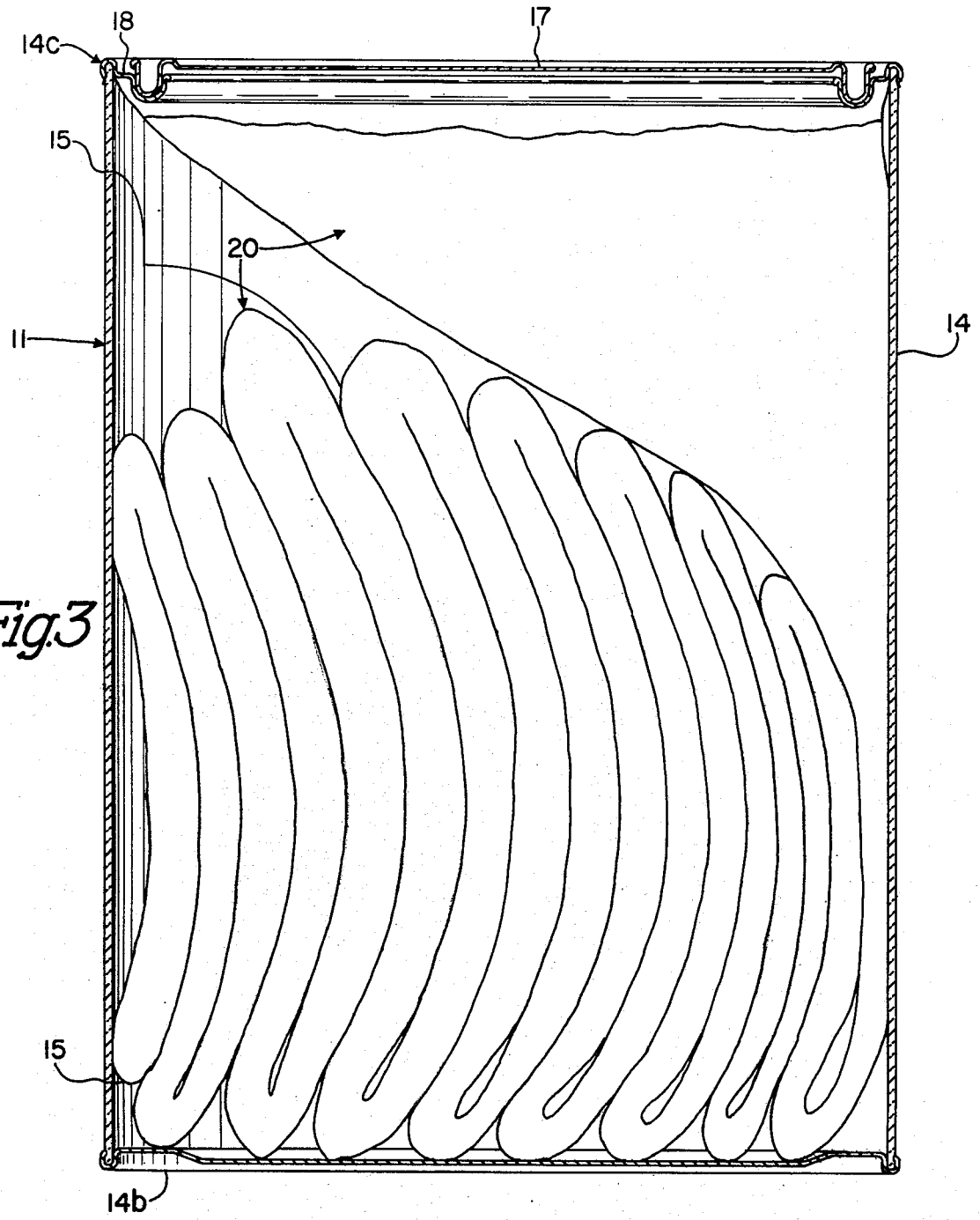
FIG. 3 is an enlarged side elevational view substantially in cross section of the fluid collector of FIG. 2.
Figure 4:
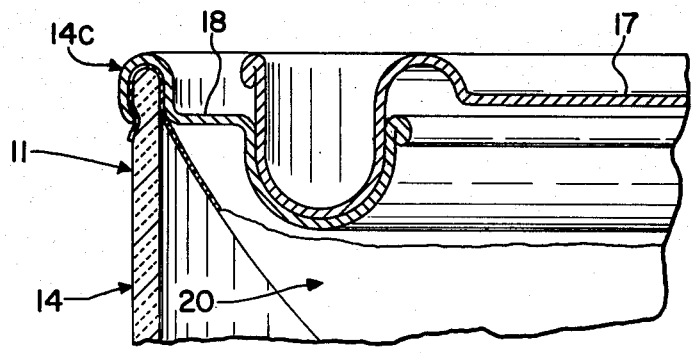
FIG. 4 is an enlarged view of the upper left corner of the container shown in FIG. 3.

In a preferred embodiment of a fluid collector 11 shown in FIGS. 2–4, a cylindrical container 14 is provided. The container 14 comprises a cylindrical sidewall **14*a*, a bottom wall 14*b*, and a top wall or closure arrangement 14*c*. Although other materials may be used, the sidewall 14*a* is preferably formed of a paperboard material. A large area of the sidewall 14*a* is encircled by a weakened line 15. At the upper portion of the weakened line circle 15 a thumb-sized further weakened tab configuration 15*a* may be formed. It is intended that an appropriate legend be placed within the weakened line 15 as at 16 instructing a person to push in the tab 15*a* to separate it from the container sidewall 14*a*, and to further indicate that the tab 15*a* should be grasped and pulled away from the container sidewall 14*a* to tear the area of the sidewall 14*a* encircled by the weakened line 15 away from the container sidewall 14*a*. It may be seen that that removal operation exposes a substantial portion of the interior of the container 14**.

Although other materials may be used, bottom wall **14*b* and the closure 14*c* are preferably formed of a sheet metal. As can be seen in FIG. 3, the bottom wall 14*b* is crimped or seamed to the lower end of the sidewall 14*a* of the container 14**.

Preferably the closure **14*c* is formed with a removable and replaceable lid. The arrangement shown comprises a lid 17 and an annular lid receiving flange 18. The inner periphery of the annular flange 18 is provided with an upwardly open annular groove for grippingly receiving an annular depending shoulder on the lid 17 in a firm fluid sealing relationship. The outer periphery of the annular flange 18 is provided with a downwardly open annular groove that may be crimped or seamed about the upper edge of the sidewall 14*a* of the container 14**.

The invention contemplates that other known forms of closure arrangements that may be manually removed from the container and later reapplied in a fluid sealing relationship may be used in place of the preferred embodiment described.

Any closure arrangement contemplated is preferably one that will also secure the open end of the bag 20 about and within the upper rim portion of the container 14. The fluid collector 11 further includes the bag 20 in the container 14. In a preferred form, the bag 20 is shaped as an elongated tube of a transverse circumferential dimension that is substantially uniform longitudinally of the bag 20, and the open end of the bag when opened into the circle configuration of the container sidewall **14*a*, preferably has a circumferential dimension allowing the open end of the bag to be folded over the upper edge of the sidewall 14*a* of the container 14 such as shown in FIGS. 3 and 4. In constructing the fluid collector 11, the open end of the bag 20 is folded over the upper edge of the sidewall 14*a* of the container 14 before the annular flange 18 is mounted on the sidewall 14*a*. The initial assembly of the fluid collector 11 contemplates that the bag 20 in an accordian-pleated condition, such as shown in FIG. 3, be placed within the container 14. The open end of the bag 14 is then circumferentially folded over the upper edge of the sidewall 14*a*, and the annular flange 18 and the lid 17 are applied over the open end of the bag 20 and the upper end of the sidewall 14*a*. The sidewalls of the downwardly open annular groove of the annular flange 18 are then crimped or seamed against the sidewall 14*a* to secure the open end of the bag 20 and the annular flange 18 onto the upper end of the sidewall 14*a*. The crimping or seaming operation should be such as to provide an adequate fluid seal between the annular flange 18 and the interior of the open end of the bag 20 and to securely lock the annular flange 18 on the sidewall 14*a* of the container 14. The placement of the folded bag 20 in the container 14 should be such that the closed end of the bag 20 is immediately adjacent to the area of the sidewall 14*a* encircled by the weakened line 15. If the bag 20 is formed in the cylindrical shape described, it should have a length sufficient to provide a total volume capable of receiving the total amount of fluid to be collected from the drain opening. Portions of the bag 20 below the open end may have other shapes if desired. Preferably, any other selected bag shape should be one that permits the bag 20 below the open end thereof to be easily drawn from the container 14 through the opened sidewall. Further, in a preferred embodiment, the bag 20 is made from an easy deformable elastic plastic material such as polyethylene. Other materials may be used in making the bag 20**, but the bag material selected should be one that is strong enough to enable the bag to be handled without being easily ruptured when the bag is filled with fluid.

Figure 5:
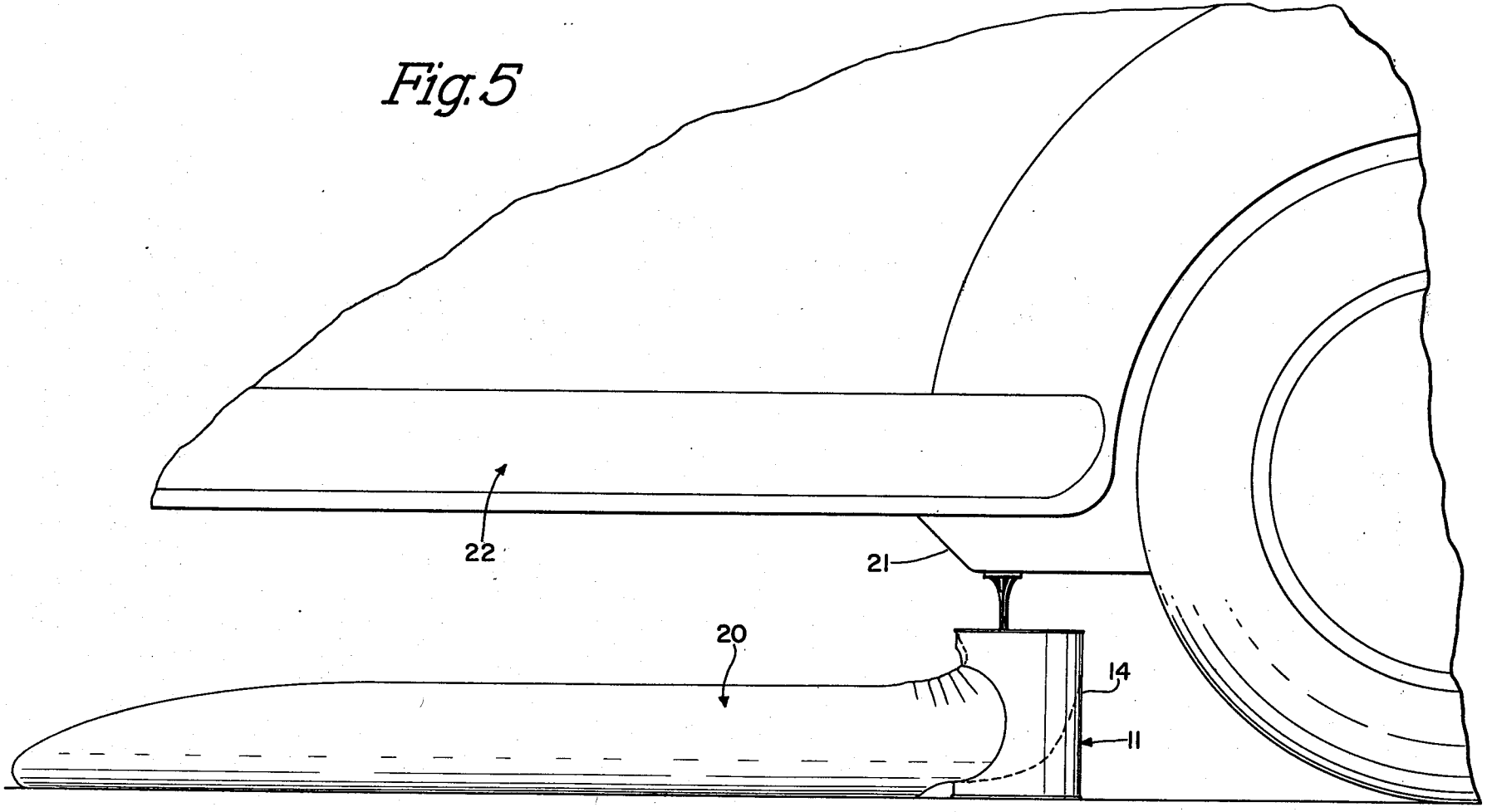
FIG. 5 is a side elevational view of a portion of an automobile showing used oil draining into the fluid collector of the invention.

The contemplated use of the fluid collector 11 involves firstly removing the fluid collector 11 from the carrier device 12, and thereafter removing the lid 17 from the annular flange 18 such as by prying it therefrom, and further removing the sidewall portion of the container 14 encircled by the weakened line 15 as described. The closed end of the bag 20 is then drawn through the open sidewall and extended to its full length such as shown in FIG. 5. Using the container 14 absent the lid 17, substantially as a self-supporting funnel, the container 14 with the extended bag may then be placed upon the ground beneath the drain opening from which fluid is to be collected, such as beneath the oil pan 21 of the automobile 22 partially shown in FIG. 5. The oil pan drain plug may then be removed allowing the used engine oil to flow therefrom into the open upper end of the container 14 and bag 20. The draining oil will then flow through the open sidewall into the extended portion of the bag 20. Many standard quart oil cans have a height of about five and one-half inches, and a diameter of about four inches. Those skilled in this art will appreciate that the open container at that height and of that diameter will adequately fit beneath the oil pan of the average automobile and will be sufficiently large enough to receive the draining oil therewithin. When the oil draining operation is complete, the oil pan drain plug may be replaced, and the container 14 may be grasped and pulled from beneath the automobile. The lid 17 may then be reapplied to the container and pressed into place to seal the upper end of the container 14. The container 14 and fluid filled bag 20 may then be picked up and carried to an appropriate disposal site. The replacement-oil containers may then be withdrawn from the carrier device 12 and opened for draining of replacement oil into the automobile engine.

Having described the invention it is to be understood that changes can be made in the described embodiments by one skilled in the art within the spirit and scope of the claims.

I claim:

1. A multipackage comprising an odd numbered plurality of oil cans containing fluid, a used-oil collector and a carrier device, said collector comprising a can of substantially the same size and external configuration as one of said oil cans, said oil cans and said collector arranged in a pattern of parallel rows and ranks perpendicular to said rows, said carrier device comprising a member holding said oil cans and said collector together in a unitary package capable of being carried by a person, said can of said collector having a manually removable and resealable cover and a flexible bag folded therewithin, said can of said collector having a cover rim ring member, the inner periphery of which is adjacent to the inner periphery of the sidewall of said can of said collector, said cover being formed to fluid seal said can of said collector about said rim thereof, the open end of said bag secured about the rim of said can of said collector in a fluid sealed relationship therewith and independently of said cover, a sidewall portion of said can of said collector having a cover being manually removable to permit the major portion of said bag which extends from said open end thereof to be manually drawn from the interior of said can in a fluid receiving relationship to said open end of said bag, and said bag having a capacity at least as large as the total volume of said plurality of oil cans.

2. A multipackage as defined in claim 1, wherein said member of said carrier device comprises a plurality of annular bands integrally interconnected in a pattern of rows and ranks corresponding to the pattern of said oil cans and said collector, said bands formed of a resilient elastic material and each of said bands having an initial inner peripheral dimension less than the outer circumferential dimension of said oil cans and said collector, and each of said bands being mounted in a stretched circumferentially embracing condition about one of said oil cans and collector.

3. In a disposable used-oil collector for collecting oil draining from the oil drain outlet of the oil pan of a vehicle in which the collector comprises a bag and a funnel, the improvement of said collector comprising a container having a substantially closed sidewall and base capable of supporting said container in an upright condition upon the ground and below the oil drain outlet of the oil pan of a vehicle from which oil is intended to be collected and having an upper open end of an area substantially equal to the transverse cross-sectional area of said container and a height less than the distance from the ground to the oil drain outlet of the oil pan of a vehicle from which oil is intended to be collected, a flexible bag having one open end and an internal volume at least two times greater than the volume of said container, said flexible bag disposed in a collapsed condition in said container upon said base, an annular cover securing rim ring, the outer periphery of said annular cover securing rim ring being seamed onto the upper end of said sidewall of said container with the open end of said bag disposed therebetween to fix the open end of said bag to the upper open end of said container, a cover closure, the inner periphery of said annular cover securing rim ring being formed to receive said cover closure secured in a fluid sealed relationship over the upper open end of said container and said one open end of said bag, said cover closure and said inner periphery of said annular cover securing rim ring being formed to permit removal of said cover closure and manual reapplication to said container to seal said one open end of said bag, and a sidewall portion of said container including a removable cover being manually removable to permit the major portion of said bag below said one open end to be manually drawn from said container in a fluid receiving relationship to said one open end of said bag after manual removal of said sidewall portion cover.

4. A disposable used-oil collector as defined in claim 3, wherein said bag is shaped as an elongated tube of substantially uniform transverse width.

5. A disposable used-oil collector as defined in claim 4, wherein the circumferential dimension of said bag in a transverse direction is substantially equal to the circumferential dimension of said upper open end of said container.

6. A disposable used-oil collector as defined in claim 3, wherein said bag is formed of a resilient, elastic plastics material.

7. A disposable used-oil collector as defined in claim 3, wherein the sidewall of said container is formed of a paperboard material, and said sidewall portion cover comprising a weakened manually frangible area of said sidewall of said container.

* * * * *